United States Patent [19]

Chun

[11] Patent Number: 4,653,960

[45] Date of Patent: Mar. 31, 1987

[54] SUBMERSIBLE OFFSHORE DRILLING PRODUCTION AND STORAGE PLATFORM WITH ANTI-CATENARY STATIONING

[76] Inventor: Joong H. Chun, 5205 Broughman La., Plano, Tex. 75023

[21] Appl. No.: 864,845

[22] Filed: May 20, 1986

[51] Int. Cl.[4] ..... E02D 27/38; E02B 29/06

[52] U.S. Cl. ..... 405/210; 114/264; 405/195; 405/224

[58] Field of Search ..... 405/210, 195, 202, 203, 405/204, 52, 224; 114/264, 265

[56] References Cited

U.S. PATENT DOCUMENTS

| | | | |
|---|---|---|---|
| 3,504,496 | 4/1970 | Hnot | 405/53 |
| 3,572,278 | 3/1971 | Knapp et al. | 405/210 X |
| 3,889,477 | 6/1925 | Tam | 405/210 |
| 3,898,846 | 8/1975 | McCabe | 405/210 |
| 4,402,632 | 9/1983 | Cook | 405/210 |
| 4,433,940 | 2/1984 | Harrison | 405/210 |
| 4,531,860 | 7/1985 | Barrnett | 405/210 X |

*Primary Examiner*—Dennis L. Taylor
*Attorney, Agent, or Firm*—James L. Jackson

[57] ABSTRACT

A submersible offshore crude oil separator and storage facility for petroleum products which may also form a stable platform which an offshore structure or vessel for drilling or production of petroleum products may be removably located. The buoyancy of the oil separator and storage vessel and platform facility is controllable to compensate for the weight of apparatus to be located thereon and production fluid to be contained therein. An elongated storage chamber defined therein may be in the form of a plurality of vertical compartments to insure the safety and integrity of the system should one of the compartments become ruptured or otherwise develop a leak. The storage chamber is pressure balanced with the hydrostatic pressure of sea water thus permitting it to be manufactured of relatively light weight and low cost materials as compared to vessels designed to withstand hydrostatic pressure and/or internal pressure. This service and storage facility is maintained at a marine site by a plurality of anti-catenary lines which radiate therefrom and which are secured to appropriate anchors at the ocean floor. These anti-catenary lines are defined by interconnected tubular members forming a tube chain, the tubular members having air interchange buoyancy control to offset catenary forces, thus rendering the anchoring line substantially neutrally buoyant.

20 Claims, 21 Drawing Figures

SUBMERSIBLE OFFSHORE DRILLING PRODUCTION AND STORAGE PLATFORM WITH ANTI-CATENARY STATIONING

FIELD OF THE INVENTION

This invention relates generally to offshore petroleum installations for drilling, production and storage of petroleum products. More specifically, the present invention is directed to a submersible or semisubmersible storage for petroleum products which of substantially buoyant nature in water for efficient undersea storage of petroleum products. Even further, the invention concerns a submersible offshore petroleum storage facility which not only functions as a crude oil separator but also functions as an efficient support for drilling and production platforms or vessels for conducting drilling and production operations.

BACKGROUND OF THE INVENTION

As the need for petroleum products developed over the years, wells were typically drilled and produced through employment of land based operations. Petroleum exploration as continued on land until, at this point, most major oil finds have been identified and production therefrom has been initiated. Obviously many small oil and gas reservoirs have not yet been located but, in time will be identified and produced to the extent that they are cost effective.

In its effort to locate significant reservoirs of petroleum products, the petroleum industry began prospecting in the marine environment a number of years ago. Many significant petroleum reservoirs have been identified and offshore drilling and production has likewise been developed to the extent that much of the worlds oil production now comes from reservoir beneath the sea. In order to locate, drill and produce subsea petroleum reserves, the equipment and procedures for the same become extraordinarily expensive. For example, at the cost of many millions of dollars, an offshore platform is designed, constructed and installed. If the platform is a drilling platform typically a number of wells are drilled from a single platform thereby amortizing its cost per well. A platform of this nature is typically a permanent installation and therefore only becomes cost effective in the event the petroleum reservoir is of significantly great volume that the effective service life of the platform will be in the range of from 20 to 40 years. If the petroleum reservoir is of small nature, though it may contain a significant volume of petroleum products, nevertheless it is not cost effective and therefore further exploration, drilling and production activities will be deferred until such time as increased oil prices renders drilling completion and production activities cost effective. It is desirable, therefore, to provide a system for drilling, completion and production of petroleum products which renders small petroleum reserves cost effective. This is accomplished by providing a platform system which may be temporarily located at the site of a small petroleum reserve. Multiple wells may then be drilled and produced utilizing the mobile platform system. After the petroleum reserve has been sufficiently depleted that further production is not cost effective, the wells can be shut-in and the platform apparatus moved to the marine site of another small petroleum reserve. Since the apparatus provides a self contained storage facility, it is not necessary to lay expensive offshore pipeline systems to conduct petroleum products to a remotely located gathering facility. Petroleum products recovered from the offshore reservoir may be loaded directly from the facility onto tankers or other appropriate petroleum transportation vessels for transportation to an appropriate storage and refining system.

Submersible and semisubmersible production and storage facilities as well as floating petroleum service vessels must be maintained at rather precise locations relative to the ocean floor to permit the specialized operations that are involved. In case of drilling precise stationing of the drilling rig is necessary to maintain the rotating drill stem as straight as possible as it is being rotated by the drilling rig. Especially in foul weather conditions and rather deep water locations, the vessels and structures are likely to be laterally displaced by wave action, wind and current. In cases where conventional mooring is accomplished by means of mooring cables or chains, the forces of wind current and wave action can cause tightening of the cables on one side of the vessel or structure and consequent loosening of the opposite cables, thus allowing the vessel or structure to shift laterally. The amount of lateral shifting or excursion that occurs depends on the forces applied to the vessel and to the curvature present in the mooring cables or chains. For example, a conventionally moored floating or semisubmersible vessel in 600 to 1,000 feet of water will be capable of lateral excursion in the order of 45 feet because of the catenary (curvatures) defined in the mooring cables. However, drilling activities can take place only when the structural or vessel is maintained within prescribed limits of lateral excursion. Drilling activities can therefore be conducted only when the drilling vessel misalignment above the wellbore is maintained to within about 2% of water depth. Under circumstances where wind, wave action and current cause the vessel or structure to shift laterally beyond the maximum prescribed for drilling, such drilling operations must cease. When drilling or servicing operations are being conducted in marine environments where stormy conditions frequently occur, for example in the North Atlantic and North Sea areas, drilling rigs are required to shut down quite frequently simply because the wind conditions, wave action and currents cause lateral excursion of the drilling rig beyond acceptable limits. This, of course, is detrimental to the cost of drilling operations because the fixed cost of maintaining the vessel, equipment and personnel continues during such periods of inactivity. It is of course desirable to provide a mooring system for floating and semisubmersible drilling rigs which will significantly reduce the amount of down time that is presently due to adverse weather conditions.

It is desirable, therefore, to provide a mooring system having no catenaries, thus efficiently minimizing lateral excursion in response to forces generated by wave action, wind and current and maintain the structure stable within allowable limits. In the case of submersible systems, obviously wind is not a factor and wave action may be only a minimal factor if the depth of location is well beyond significant influence of wave action. In such cases, the major force requiring resistance for efficient stationing of submersible apparatus is the force of current. Even in placid sea conditions, currents can run from less than one knot to a speed in the order of five knots under which directional variation of lateral excursion can be a significant factor. It is desirable, therefore, to provide a mooring system for submersible and semisubmersible petroleum storage systems and service vessels which is substantially catenary free, thereby minimizing lateral excursion of the system or vessel.

SUMMARY OF THE INVENTION

It is therefore a primary feature of the present invention to provide a novel submersible or semisubmersible petroleum storage vessel which may be appropriately stationed in deep water conditions where wave action and wind are an insignificant factor.

It is another feature of this invention to provide a novel submersible or semisubmersible storage system which is capable of providing support for an offshore drilling, production or servicing facility, enabling such facility to relocate without requiring relocation of the subsea facility. It is also an important feature of this invention to provide a novel petroleum gathering and storage facility which may be transported without any requirement for barges or other carrying devices and which may be efficiently transported to other appropriate sites when its presence becomes non-cost effective at a particular site.

It is another feature of this invention to provide a novel submersible or semisubmersible petroleum storage facility which can be deployed in any deep sea and whose construction cost is almost independent of the depth of the sea to be deployed by automatically balancing the storage chamber pressure and the hydrostatic pressure of the surrounding sea water.

It is another feature of this invention to provide a subsea petroleum storage facility which can also function as a crude oil separator thereby eliminating the need of installing additional separator apparatus on the production platform.

It is another feature of this invention to provide a novel submersible or semisubmersible petroleum storage facility which employs substantially catenary free stationing by means of a plurality of anchoring lines, each being rendered substantially catenary free by means of gas controlled buoyancy chambers.

It is an even further feature of this invention to provide a novel submersible or semisubmersible petroleum storage facility which also functions as a vessel loading facility, permitting petroleum products to be loaded therefrom onto ocean going tanker vessels to thus eliminate any need for undersea pipelines.

It is also a feature of this invention to provide a novel catenary free mooring system incorporating gas controlled flotation devices which are automatically pressure balanced with hydrostatic pressure at the particular level thereof relative to the ocean surface.

Briefly, the present invention concerns the provision of a petroleum storage facility which is capable of being located in submerged or semisubmerged manner at the site of a petroleum reserve which may be of sufficiently limited capacity as to render permanent platform installations economically unsound. The storage facility of this invention is capable of being transported to its intended site without any need for barges. The storage facility is then stationed at the intended site by means of substantially catenary free anchor systems which anchor it to the structure of the ocean floor. The storage facility may serve efficiently as a support platform for a drilling or production rig.

When the production from the field involved diminishes to the point it becomes economically unsound, the offshore storage facility may be disconnected from its mooring and may be efficiently transported to another intended site for petroleum production. Since the apparatus is intended basically for location in submerged or substantially submerged condition well below the depth of significant wave action, it need not be of sufficient structural integrity to withstand the forces of continual wave action. It may be of relatively light weight and therefore inexpensive construction as compared to that of surface based petroleum storage facilities.

For efficient mooring and stationing of the storage facilities hereof, a mooring system is utilized which does not develop any substantial catenary action. The catenary free mooring system incorporates a plurality of elongated tension members which are interconnected in end to end relation by suitable connecting means such as lengths of chain. Alternatively, tension forces may be restrained by a wire rope of sufficient dimension and gas activated buoyancy chambers may be employed to provide offsetting buoyancy to counterbalance catenary developing forces. In either case the neutrally buoyant anchor lines extend in substantially straight line condition from selected points on the vessel to location on the ocean floor where appropriate anchors are provided. Since the mooring lines are maintained in substantially catenary free straight line relation by virtue of their neutral buoyancy in water, lateral excursion of the storage vessel or structure to which the upper extremity of the lines are connected is permitted only within the limits of designed tension elongation that is allowed to occur as excursion inducing forces are resisted. In essence, each anchor line will incorporate a plurality of gas charged chambers which will be maintained at a substantially hydrostatically balanced condition relative to the depth of sea water at which they are located. After installation and gas filling, each of the various buoyancy chambers may be simultaneously monitored both electrically and pneumatically to thus insure that each of the buoyancy chambers is free of leakage. Should leakage occur, the system provides for automatic replenishment of leaked gas until such time as the floatation chamber may be replaced or repaired.

The anti-catenary mooring systems may incorporate features set forth in U.S. Pat. No. 4,491,709, issued on Sept. 18, 1984 to Joong H. Chun.

Other and further objects, advantages and features of the present invention will become apparent to one skilled in the art upon consideration of this entire disclosure. The form of the invention, which will now be described in detail, illustrates the general principles of the invention, but it is to be understood that this detailed description is not to be taken as limiting the scope of the present invention.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings, which drawings form a part of this specification.

It is to be noted, however, that the appended drawings illustrate only typical embodiments of this invention and are therefore not to be considered limiting of its scope, for the invention may admit to other equally effective embodiments.

In the Drawings:

FIG. 1 is a pictorial illustration in elevation showing a submersible petroleum storage facility which is positioned with its lower extremity in contact with a support pad at the sea bottom.

FIG. 2 is a pictorial illustration of another submersible petroleum storage facility which is shown to be stationed by means of anti-catenary mooring lines and by a positive tethering chain connected by an anchor to the sea floor.

FIG. 3 is a pictorial illustration of a subsea storage facility such as that shown in FIG. 2 and which provides support for an offshore drilling, service or production platform which may be floated into place and jacked up to its operating position.

FIG. 4 is an illustration of a semisubmersible petroleum storage facility which also provides support for a platform structure which may be floated into place and raised to its operative position.

Figure 4A:
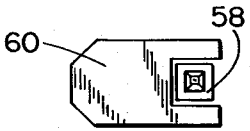
Figure 4:
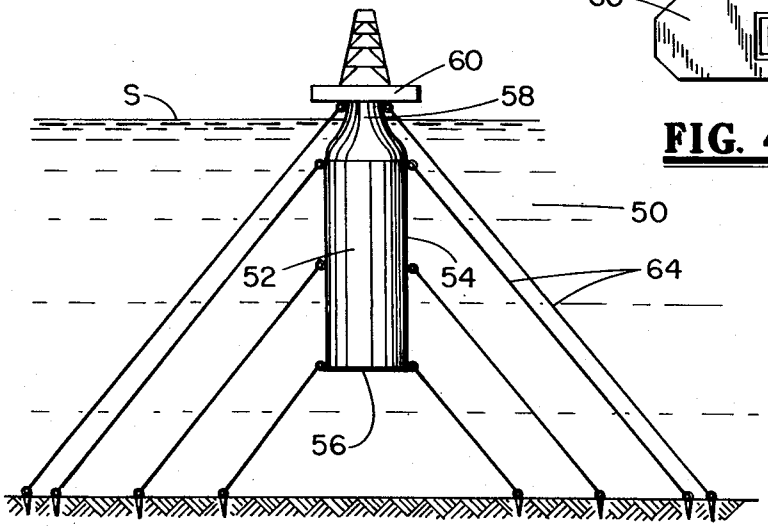

FIG. 4*a* is a planned view of FIG. 4 showing the vessel to be a slotted vessel for receiving the reduced diameter upper extremity of the storage vessel.

Figure 5:
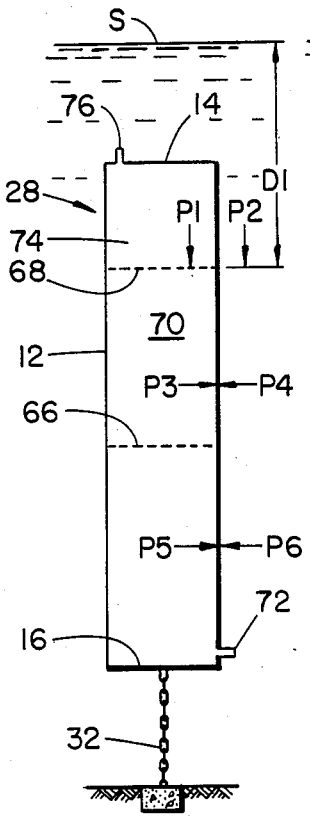

FIG. 5 is a pictorial diagram of a submersible petroleum storage facility illustrating the balanced pressure condition thereof relative to hydrostatic pressure at various depths of sea water.

Figure 6:
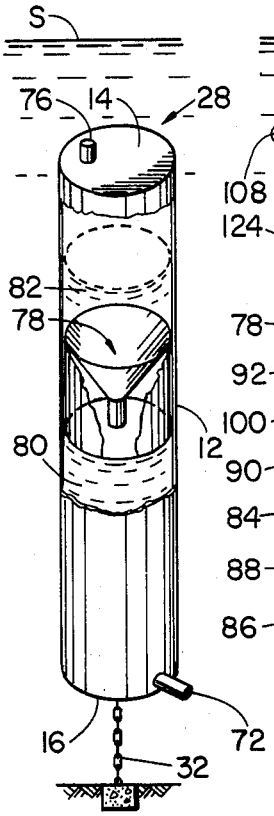

FIG. 6 is an isometric illustration of a submersible petroleum storage facility illustrating the general configuration thereof and the general configuration of a piston member at the oil/water interface within the vessel structure.

Figure 7:
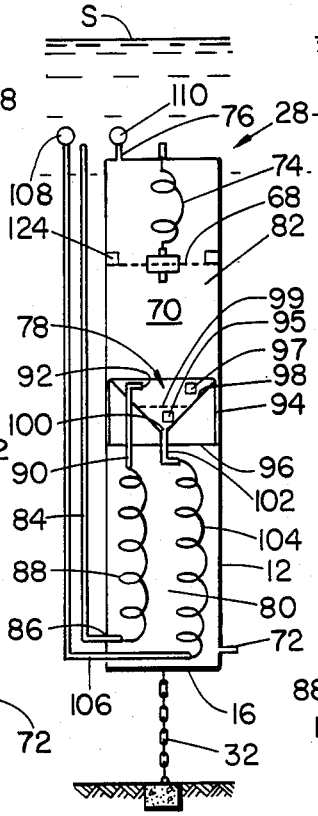

FIG. 7 is a pictorial representation in section of a submersible petroleum storage vessel showing the piston member at an intermediate position and illustrating the character of other components thereof.

Figure 8:
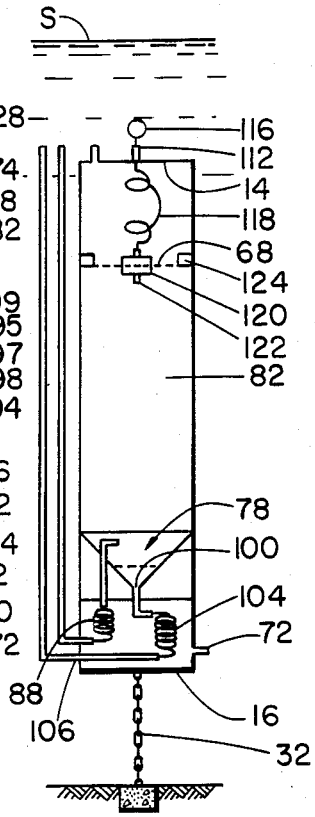

FIG. 8 is a sectional view similar to that of FIG. 7 illustrating the piston member at or near its lower most position within the internal chamber of the apparatus.

Figure 9:
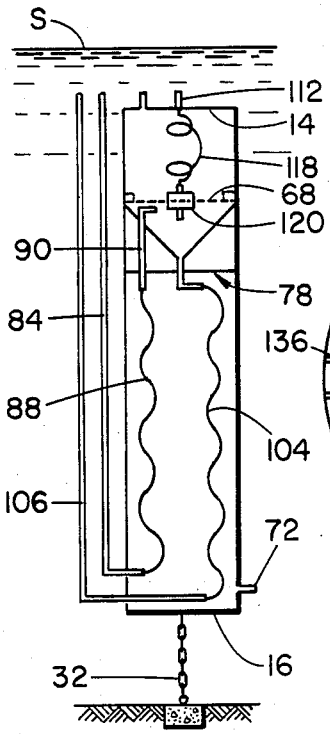

FIG. 9 is a sectional view similar to that of FIGS. 7 and 8 and showing the oil/water interface piston at or near its upper most level within the internal chamber of the storage facility.

Figure 10:
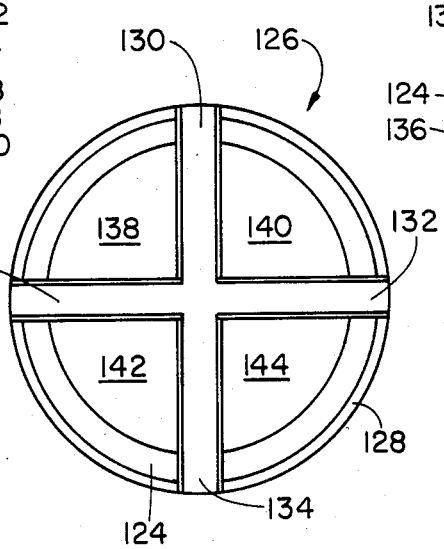

FIG. 10 is a planned view illustrating a modified embodiment of the present invention wherein the petroleum storage facility incorporates a plurality of independent storage chambers, with oil/water interface pistons independently movable within each chamber.

Figure 11:
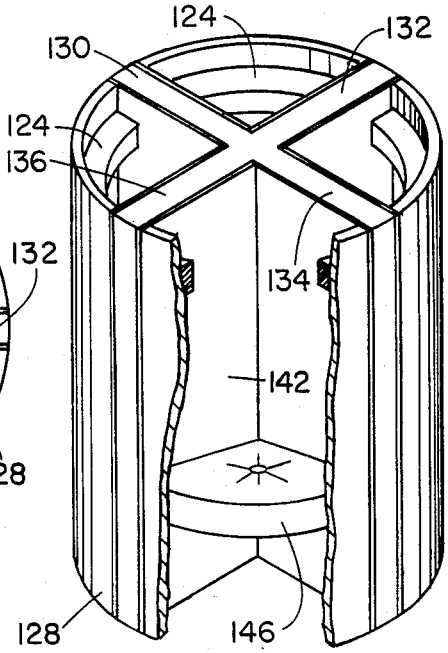

FIG. 11 is an isometric illustration of the subsea storage facility of FIG. 10 with parts thereof broken away to show the structural core thereof in detail.

Figures 12, 13, 14:
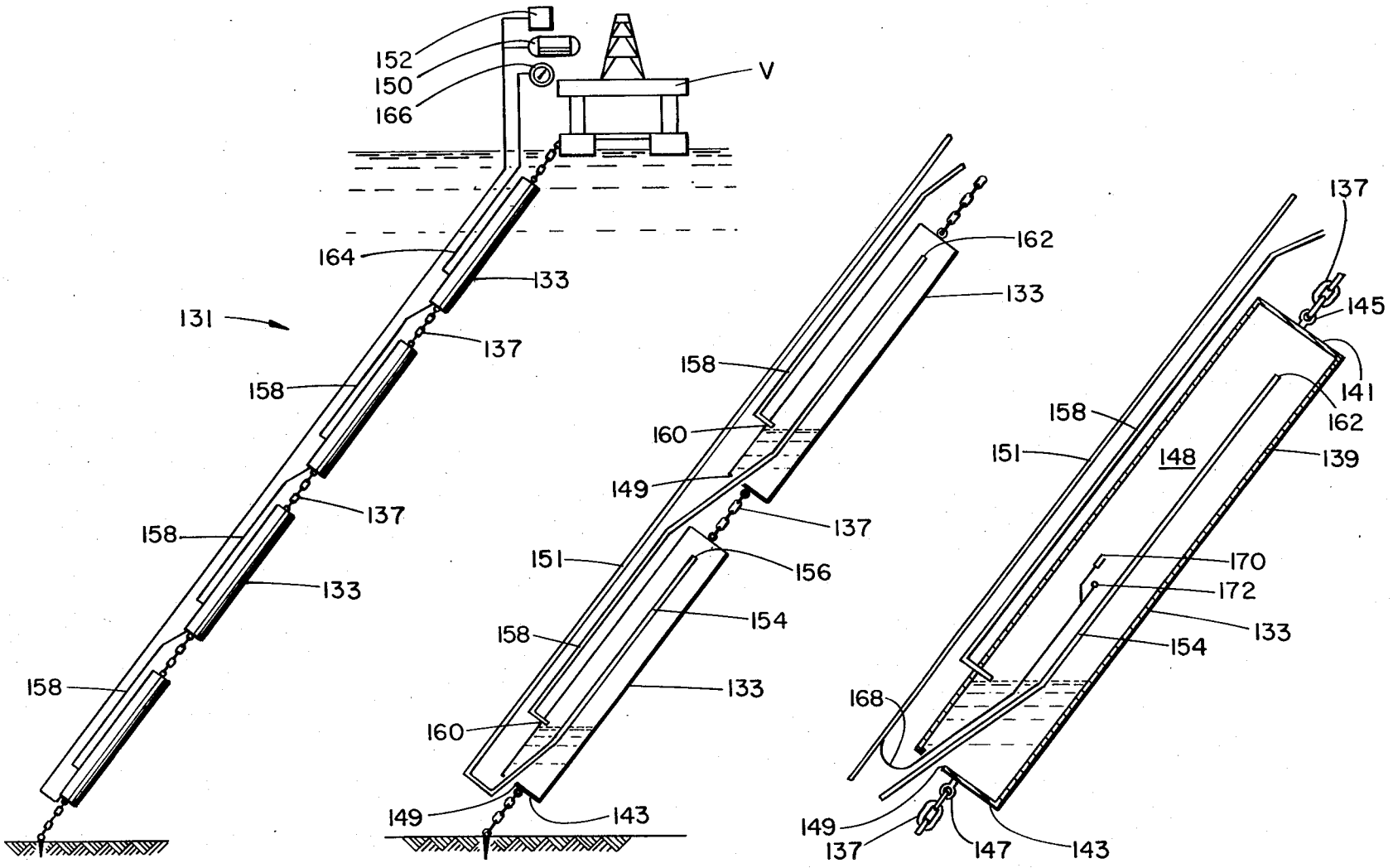

FIG. 12 is a partial pictorial illustration in section, showing stationing of a semisubmersible platform by means of an anti-catenary mooring line constructed in accordance with the present invention.

FIG. 13 is a partial sectional view of the anti-catenary mooring line of FIG. 12 illustrating the integrated gas maintenance system thereof in detail.

FIG. 14 is a sectional view of one of the buoyancy chambers of the anti-catenary mooring line of FIGS. 12 and 13, illustrating the maintenance and monitoring system thereof in detail.

Figure 15:
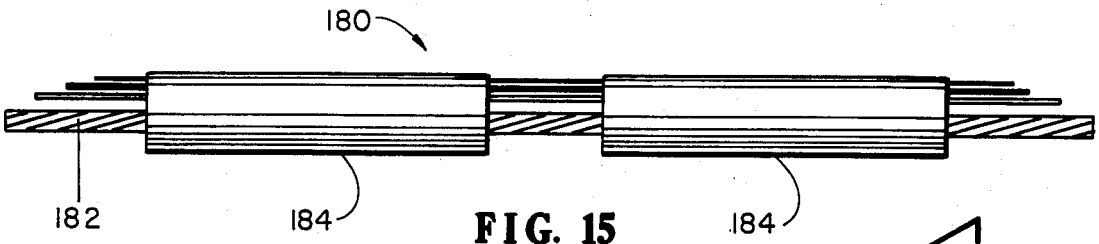

FIG. 15 is an elevational view illustrating an anti-catenary mooring line representing an alternative embodiment of this invention.

Figure 16:
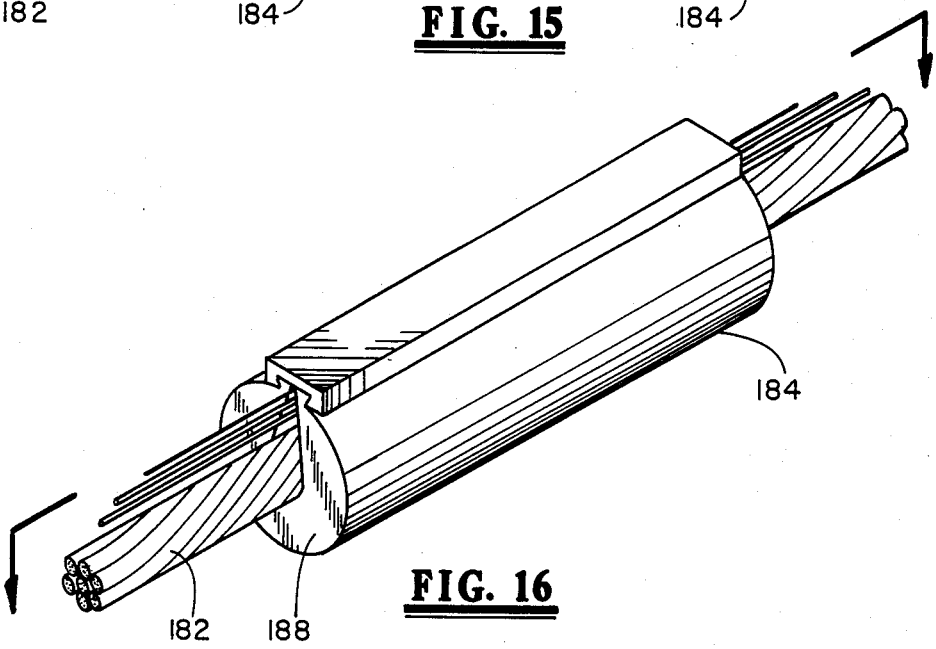

FIG. 16 is a partial view of the apparatus of FIG. 15, being shown by way of isometric illustration.

Figure 17:
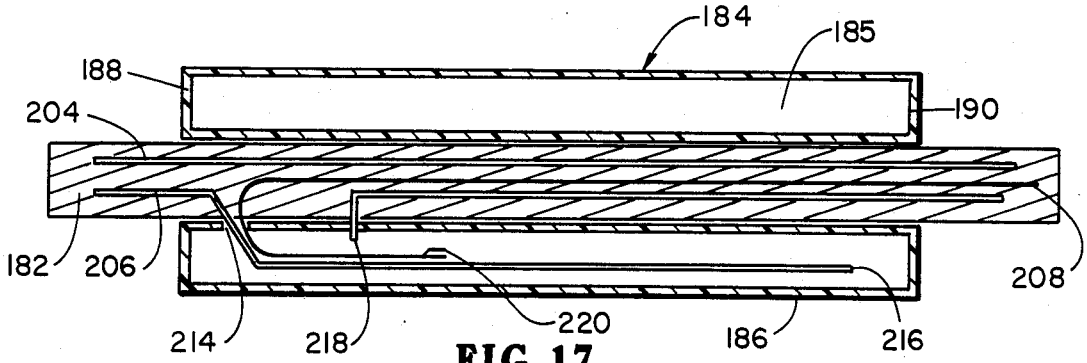

FIG. 17 is a sectional view taken along line 17—17 of FIG. 16.

Figure 18:
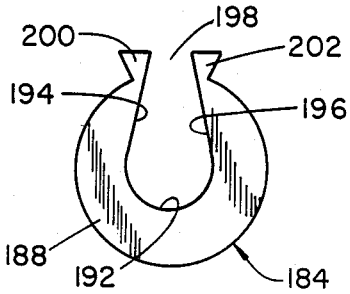

FIG. 18 is an end view of the buoyancy chamber of FIG. 16 with the retainer cap removed therefrom.

Figure 19:
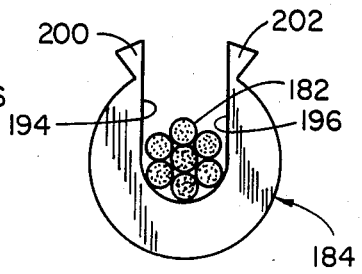

FIG. 19 is an end view similar to that of FIG. 18 showing a wire rope mooring cable received thereby and spreading the locking connections thereof.

Figure 20:
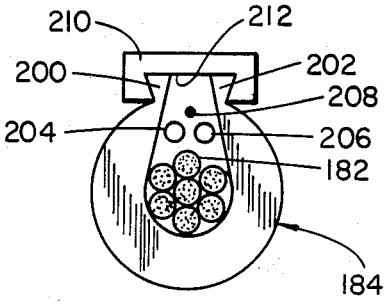

FIG. 20 is an end view of the apparatus of FIG. 19, showing the locking devices thereof being forced together to secure the buoyancy chamber to the mooring cable by way of frictional attachment and showing the retainer cap member in locking relation with the locking members thereof.

DETAILED DESCRIPTION OF PREFERRED EMBODIMENT

Figure 1:
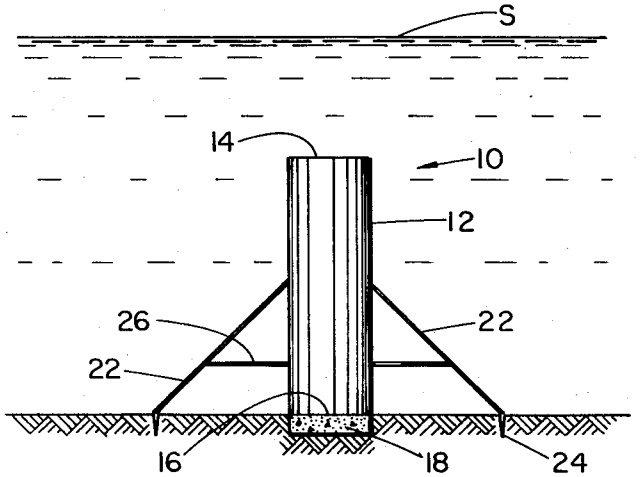

Referring now to the drawings and first to the pictorial representation of FIG. 1, a subsea petroleum storage facility is illustrated generally at 10 having a sidewall structure 12 to which upper and lower walls 14 and 16 which are secured by an appropriate structural framework. Within the storage facility 10 variable volume chambers are defined in the manner discussed above in connection with FIGS. 5–9. The term substantially neutrally buoyant as used herein is intended to include a range from slightly positive to slightly negative buoyancy, including structures having an adjustable buoyancy from slightly positive to slightly negative. The storage facility 10 of FIG. 1 always maintains a negative buoyancy and is shown to be positioned with its lower wall 16 resting on a concrete pad 18 installed in the ocean floor 20. Installation is such that the upper wall structure 14 is located at a suitable depth below the sea surface S such that the upper end of the storage facility is below the level of wave action. The upper extremity of the storage facility is also at sufficient depth that it does not interfere with deep draft ocean going vessels. The storage facility is secured by means of a plurality of transverse braces 22 which are secured at the lower ends thereof to the ocean floor by means of suitable anchors 24. Intermediate transverse braces 26 may be employed to further strengthen and stabilize the subsea storage facility and to stabilize it against the influence of ocean currents.

Figure 2:
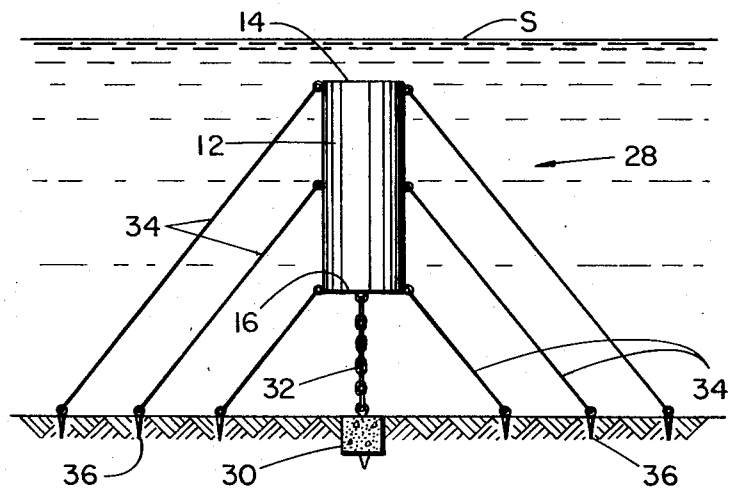

Referring now to FIG. 2, a subsea petroleum storage facility representing an alternative embodiment of this invention is shown generally at 28 and is intended to be located at an intermediate depth between the ocean floor 20 and the surface S. The storage facility 28 may be of similar construction to the storage facility 10 except for its anchoring or stationing system and its maintenance of positive buoyancy. The lower wall structure 16 is secured to an appropriate anchor 30 at the ocean floor by means of an anchor chain 32 which restrains vertical excursion of the storage facility but is capable of collapsing should the storage facility move downwardly. The storage facility is further stationed by a plurality of angulated anchor lines 34 which are respectively connected to upper, intermediate and lower portions of the elongated storage vessel. The lower ends of the anchor lines are secured to appropriate anchors 36 which are securely connected to the ocean floor. Each of the anchor lines 34 are preferably of the anti-catenary type as shown and described in connection with FIGS. 12–20 hereof.

Figure 3:
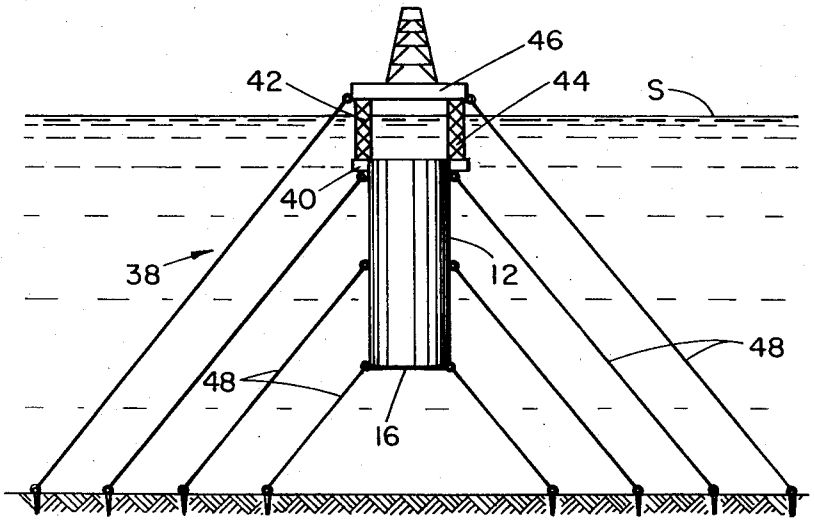

As shown in FIG. 3, a subsea storage facility is shown generally at 38 which may be of similar construction as the storage facility 28 of FIG. 2 with the exception that the upper extremity of the elongated storage vessel is provided with a laterally extending flange 40 which functions as the landing area for the legs 42 and 44 of a platform 46. The platform 46 may be a drilling platform or a service or production platform as is appropriate for the circumstances involved. The platform vessel 46 is floated into place relative to the landing flange 40 and its jacking mechanism is activated, forcing the support leg 42 and 44 downwardly until contact is made with the landing flange. Thereafter, activation of the jacking mechanism is continued until the flotation structure of the vessel 46 is suitably elevated above the sea surface S. Both the elongated storage vessel 38 and the platform structure 46 are secured against lateral excursion by means of a plurality of an anti-catenary anchor lines 48. The storage vessel 38 maintains sufficient buoyancy to support both the vessel itself and the platform structure 46.

In FIGS. 4 and 4A, a further alternative embodiment is illustrated wherein a semisubmersible storage facility is shown generally at 50 which includes an elongated storage vessel 52, the sidewall 54 and bottomwall 56 thereof being similar to that shown in FIGS. 1, 2 and 3. The upper extremity of the elongated storage vessel 52 is of reduced dimension with a portion 58 thereof protruding upwardly above the sea surface S. As is evident from FIGS. 4 and 4*a*, a drilling or service vessel 60 is adapted to be interconnected with the upper, reduced diameter support portion 58 of the storage vessel 52. In this case, the drilling/production vessel 60 may be of the slotted variety wherein the flotation portion thereof defines a slot 62 within which the support structure 58 is positioned. After the service vessel 60 has been floated into position relative to the support portion 58, it is raised by any suitable mechanism to a level above the ocean surface S where it remains to perform its drilling or servicing activities. The storage facility is maintained in place by a plurality of anti-catenary lines 64 in the manner shown in FIG. 4.

Each of the storage facility embodiments shown in FIGS. 1, 2, 3 and 4 are of mobile nature, being readily movable to an alternative site simply by disconnecting the anchor lines and towing it on the surface of the ocean in floating condition by means of service vessels. There is no need, therefore, to provide a permanent service and petroleum and service facility, thereby rendering the system readily applicable to production of petroleum reserves where long term production is not expected.

Referring now to FIGS. 5–9, the subsea storage facility 28 of FIG. 2 is described in greater detail. It should be borne in mind that each of the storage facilities shown in FIGS. 1–4 may incorporate structure shown in FIGS. 5–9. In FIG. 5, the storage vessel 28 is shown in such manner as to illustrate the pressure balanced nature thereof relative to the hydrostatic pressure of sea water at any given depth along the length thereof. An oil/water interface is shown at 66 and an oil/gas interface is shown at 68. As petroleum products are produced, typically the production flow includes crude oil, water, natural gas, and quantities of particulate generally known as basic sediment. In each case, the elongated storage vessel defines an internal chamber shown at 70 in FIG. 5. The internal chamber 70 is in communication with the sea water by means of a water inlet port or conduit 72. In absence of petroleum products, the chamber 70 is allowed to fill to a suitable level 68 where air or gas within the upper chamber portion 74 thereof provides sufficient buoyancy to maintain the storage vessel in a substantially neutrally buoyant condition. Typically it will have a substantially positive buoyancy thereby applying a significant upper force to the anchor chain 32 and the anti-catenary anchor lines, not shown. At the liquid level 68, being an interface between air or gas and liquid pneumatic pressures $p_1$ within the vessel 74 and hydrostatic pressure $p_2$ externally of the vessel, at the same sea depth $d_1$ will be balanced. The external hydrostatic pressure above the sea level $d_1$ decreases with the decreasing sea depth while the internal pneumatic pressure $p_1$ is the same within the entire internal gas occupied chamber 74. Thus, above the sea level $d_1$, the internal pneumatic pressure $p_1$ is always greater than the external hydrostatic pressure and this pressure difference gives tension rather than compression to the wall 12. Intermediate the extremity of the elongated storage vessel at pressure levels $p_3$ and $p_4$, internal hydrostatic chamber pressure $p_3$ will be balanced with external hydrostatic pressure $p_4$. The same exists at pressure levels $p_5$ and $p_6$. Throughout its length below $d_1$, therefore, the elongated storage chamber will be pressure balanced with the hydrostatic pressure of sea water. Consequently, the wall structure 12 below the sea depth $d_1$ is not required to withstand significant hydrostatic pressure. The wall structure may be quite thin.

As shown in FIG. 5 at 66, and oil/water interface will form within the internal chamber 70 as crude oil is introduced into the storage chamber. Obviously, the location of the oil/water interface will vary according to the volume of liquid introduced during production flow from wells. The gas that separates from the oil and water upon liberation obviously rises to the upper extremity of the storage chamber 70 and forms a gas compartment 74. A gas outlet conduit 76 is provided to extract gas in controlled manner and thus maintain its volume within acceptable limits for positive buoyancy of the storage system.

Referring now to FIG. 6, the elongated storage vessel is shown to be provided with an intermediate piston member illustrated generally at 78 which is designed with a specific gravity intermediate the specific gravity of sea water (1.05) and crude oil (0.75–0.95). The piston member 78 separates the internal chamber 70 into a lower sea water chamber 80 and an upper oil and gas chamber 82. The purpose of the piston 78 is to collect brine and sludge which generally accompanies with crude oil and to prevent the direct contact between crude oil in chamber 82 and fresh sea water in chamber 80. 78 prevent and minimizes the contamination of fresh sea water contained in 80 which will be allowed to in and out to the open sea through outlet 72. Therefore the contact prevention piston 78 is necessary to meet the environmental requirement on contamination of sea water. Since port or conduit 72 is always open to sea water, the chamber 80 is filled with sea water to an appropriate depth determined by the volume of oil and gas within the chamber 82. As petroleum products are introduced into the oil and gas chamber 82, the volume of oil increases and the piston member 78 is therefore forced downwardly, causing consequent expulsion of an equal volume of water from the water chamber 80 through the open water vent 72. As oil and gas products are withdrawn from the oil and gas chamber 82, obviously the piston member 78 is displaced upwardly by displacement water entering the chamber 80.

Referring now to FIG. 7, a production flow line is shown at 84 which interconnects with the production gathering lines extending from one or more wells located in close proximity to the storage facility. The production flow line is shown to connect with the lower side portion of the vessel structure 12 at point 86, thus introducing a flow of crude oil including oil, gas, water and sludge into the funnel zone of the piston member 78 which is the bottom of the internal oil chamber 70 of the storage facility. A flexible conduit 88 is connected to the incoming production flow line 84 and extends upwardly to the movable oil/water interface piston 78 where it is connected to a flow line section 90 extending through the piston structure. Thus, the incoming flow line terminates at a production inlet opening 92 located in side of the funnel zone of the piston structure 78.

The piston member 78 is generally defined by a cylindrical side wall structure 94 to which is connected a generally planar bottom wall 96. The upper wall structure of the piston is defined by a tapered wall or funnel 98 which may be of generally conical configuration as shown. Separation of crude oil takes place inside of the funnel 98. The basic sediment and water portions of the production flow exiting the opening 92 of the incoming production conduit will descend downwardly along the surface of the funnel 98 of the piston to the mouth of the funnel 100 of a sediment discharge conduit 102. The dimension of the funnel 98 is sufficiently large that most of crude oil separation process will take place inside of the funnel and thus most of brine and sludge from the crude oil will be collected and discharged through opening 102. This eliminates the potential of mixing the brine from the crude oil with fresh sea water. The sediment discharge conduit extends through the piston member and terminates at a connection receiving a flexible discharge conduit section 104. At the lower portion of the storage facility, a discharge conduit 106 extends through the wall structure 12 and is connected to the lower extremity of the flexible conduit section 104. Basic sediment and water will be conducted from the funnel surface portion 98 of the piston through the conduit sections 102 and 104 to the discharge conduit 106. The surface control equipment of the storage facility will include a pump 108 having its suction connected to the discharge conduit 106. As sludge and water collect in the funnel portion of the piston, the pump 108 may be automatically energized to thus pump off the sludge and water and conduct it to an appropriate facility for disposal.

The pump 108 will be automatically controlled by the lower and upper sensors 95 and 97 respectively which are shown in FIG. 7. Sensors 95 and 97 measure resistivity and acoustic velocity of surrounding fluid and automatically identify whether the surrounding fluid is oil or brine utilizing the difference of resistivity and/or sonic velocity of oil and brine. When the oil-brine boundary 99 rises to the level of the upper sensor 97, as the brine level increases, the sensor 97 will send a signal through an electrical cable (not shown) to the pump 108. Upon receiving this signal the pump 108 will be activated and brine will be drained. As the brine drains out the oil-brine boundary 99 will be lowered and it will touch the lower sensor 95. If this happens, the lower sensor 95 will send signal to the pump 108 and the pump will be deactivated automatically. In this way the oil-brine boundary 99 will always remain in between sensors 95 and 97 and this will prevent the drainage of oil through the pump 108 or overflow of brine contained in the funnel zone of the floating piston.

As production flow occurs, natural gas will separate from the liquid constituents of the flow and will rise to the upper portion of the oil and gas chamber 82 thereby forming the oil/gas interface 68. A pump 110 and an appropriate flow line not shown, will be in communication with the gas outlet 76. This pump is also capable of automatic energization as the oil/gas interface indicates a significant buildup of gas within the upper portion of chamber 82. As the accumulated gas is pumped off, the oil/gas interface will rise as the piston member 78 moves upwardly and the sea water will enter the lower chamber 80. As the volume of oil within chamber 82 increases to a significant level, the piston 78 will be driven downwardly thereby expelling a like volume of sea water from the lower chamber 80. As shown in FIG. 8, the piston 78 has been driven downwardly to its lower most position thereby collapsing the flexible conduit sections 88 and 104. The storage facility will also be provided with an appropriate vessel loading facility, not shown, for accumulated oil.

As is evident from FIG. 8, oil has accumulated within the oil/gas chamber 82 to the extent that the piston member 78 has been driven downwardly to its lower most position. For removal of oil from the chamber 82, an oil discharge conduit 112 is connected to the upper wall structure 114 and is in communication with an oil pump 116 having its discharge line in communication with the vessel loading facility. Thus, the pump 116 is energized to transport cumulated oil from the variable chamber 82 to a floating vessel such as an oil tanker at the surface. When the chamber 82 is completely filled with oil, it will contain a sufficient volume of oil to substantially fill an ocean going tanker vessel. Such tanker vessels may be employed to transport accumulations of crude oil to shore based facilities for permanent storage and/or refining.

A flexible conduit 118 extends downwardly from the conduit connection 112 and is connected at its lower extremity to a floating buoy 120 having a suction inlet 122. The buoy 120 is always located at the oil/gas interface 68 by virtue of its flotation capability. The flexible conduit 118 allows permissive movement of the buoy 120 as the oil/gas interface changes. As crude oil is withdrawn from the variable volume chamber 82, a slight pressure differential will be developed between chambers 82 and 80. This slight pressure differential induces immediate movement of the piston member 78 upwardly. As shown in FIG. 9, the piston member 78 has moved to its upper most position, virtually all of the oil having been discharged. It will be desirable to limit upward movement of the piston 78 within the internal chamber of the storage facility. Accordingly, an internal stop ledge or flange may be provided as shown at 124 which is of sufficient structural integrity to form a positive stop as the piston member reaches its upper limit of travel it will contact the stop ledge 124 whereupon further upper movement of the piston is precluded.

It should be pointed out that the system can not contaminate the open sea water during the unloading of oil from the storage to the tanker. This is because sea water must enter to the chamber 80 during this operation. During the production phase of oil, sea water contained in chamber 80 must exit to the open sea very slowly. The sea water contained in chamber 80 to be discharged has very little chance to be contaminated because of the floating piston member 78 which prevent the direct contact between sea water and oil. Even if there is some residue oil which might be attached to the storage wall and remained in chamber 80, this oil will migrate upward as soon as it is detached from the wall and it will join the oil in chamber 70. The migration speed of oil in sea water is much faster than that of the downward movement of piston member 78 during the production phase. Thus, the entire system is environmentally sound.

Although a single piston is shown in FIG. 6–9 for purposes of simplicity, it should be borne in mind that the storage facility may incorporate a plurality of chambers capable of similar activity each chamber incorporating a movable piston functioning in the manner of piston 78. As shown in FIGS. 10 and 11, a storage facility shown generally at 126 is defined by a generally cylindrical wall structure 128 having transverse walls 130, 132, 134 and 136 functioning cooperatively to define a central core for the storage facility. This cental core is of significant structural integrity to resist the various forces to which it may be subjected. Between each pair of transverse wall structures is defined a variable volume storage chamber such as shown at 138, 140, 142 and 144. Each of these storage chambers will contain a movable piston member as shown at 146 in FIG. 11. The piston member 146 will typically define a tapered upper wall surface communicating with a discharge opening such as that shown at 100 in FIG. 7. The storage vessel 126 will define an internal stop ledge or flange similar to that shown at 124 in FIG. 8.

As mentioned above, it will be desirable to insure that the storage facility, whether of submersible or semisubmersible character remains accurately stationed or anchored at the intended site. Obviously, accurate stationing of the storage facility is more acute if the facility also functions as a platform for a drilling vessel in the manner shown in FIG. 3. If large anchor cables or anchor chains are employed as is typical for anchoring of offshore drilling platforms, these cables or chains will form catenaries. When the vessel is subjected to severe side loading such as may occur under the influence of wind, wave action and water current activity, the storage facility or vessel may have significant lateral excursion to the extent that certain activities conducted thereby must cease. To minimize such lateral excursion, an anti-catenary mooring system may be employed such as shown in FIGS. 12–20 hereof or as disclosed in prior U.S. Pat. No. 4,471,709.

Referring now to FIG. 12, an anti-catenary mooring system illustrated generally at 131 is employed to achieve accurate stationing of a floating platform vessel V. For purposes of simplicity, only one of the anti-catenary lines is shown in FIG. 12, it being obvious that a plurality of such lines would be employed to achieve appropriate stationing of the vessel V. Obviously, similar anti-catenary lines may be employed for accurate stationing of a submersible or semisubmersible petroleum storage facility such as shown in FIGS. 1–4.

In accordance with FIG. 12, the anti-catenary line is in the form of a buoyant tube chain having a plurality of elongated tubular sections 133 each being connected to adjacent buoyant tube sections by means of a section of anchor chain 137. As shown in detail in FIG. 14, each of the buoyant tube sections 133 comprises an elongated tubular member 139 to which is connected upper and lower end closure members 141 and 143. Connector eye members 145 and 147 are secured to the respective end closure members and receive the anchor chain 137 in the manner shown. The lower end closure member 143 of each tubular member defines a water inlet opening 149 which places the internal chamber 148 of the tubular member in open communication with the sea water within which the tubular member is submerged. Since sea water freely enters the lower portion of the tubular member, the hydrostatic pressure of sea water is communicated into the internal chamber 148, hence the internal chamber remains substantially pressure balanced with sea water at all times and becomes automatically balanced with the particular hydrostatic pressure present at the installation level of the tubular member.

As shown in FIG. 12, a gas supply line 151 is provided which conducts any suitable gas such as air from a gas supply source 150 to the buoyant tube chain. As shown in FIG. 13, the lower extremity of the gas supply line 151 is interconnected with a tube charging conduit 154 which enters the water interchange opening of the lower closure member 143 in the manner shown. The tube charging conduit 154 terminates at a discharge opening 156 located near the upper extremity of the tubular member. Thus, as gas is forced through the gas supply conduit 151, it enters the upper portion of the lower most tubular member 133.

To achieve gas charging of the other tubular members of the buoyant tube chain, gas transfer conduits are provided for conducting excessive gas from the chamber of one tubular member to the internal chamber of the next tubular member above it in serial manner.

As shown in FIG. 13, a gas transfer conduit is shown at 158 having its lower extremity connected at 160 to the lower portion of the tubular member 133. The gas transfer conduit 158 is in communication with the internal chamber 148 at the level shown. The upper portion of the gas transfer conduit 158 extends through the water interchange opening 149 of the next succeeding tubular member 133 and terminates at a gas discharge opening 162 located near the upper extremity of the internal chamber 148 in the manner shown. Another gas transfer conduit 158 of similar construction and purpose interconnects with the next succeeding elongated tubular member in the manner shown.

As gas is introduced into the interal chamber 148 of the lower most tubular member 133, the gas soon reaches the hydrostatic pressure level at the water depth within which the tubular member is located. As additional gas is introduced, the water within the internal chamber 148 is displaced through the water interchange opening 149 until the water level reaches the level shown in FIG. 13. When this has occurred, further introduction of gas forces gas upwardly through the gas interchange conduit 158 to the internal chamber 148 of the next succeeding tubular member. This causes gas energized displacement of the water within this tubular member until the water level has been displaced downwardly sufficiently to uncover the opening of the next succeeding gas interchange conduit 158. Since the next tubular member will be located at a less water depth as compared to the tubular member immediately beneath it, the hydrostatic pressure of the water and thus the internal pressure of the tubular member, though being balanced, will be at a lesser pressure. The buoyant tube chain may have as many elongated tubular members as is appropriate to reach from the ocean floor to the apparatus to be moored.

As shown in FIGS. 1–4, for example, it is obvious that the buoyant tube chains need not extend to the ocean surface rather, they will extend from the ocean floor to the particular level of attachment thereof with the vessel intended to be moored. The upper most tubular member 133 will be communicated by a conduit 164 which extends from the lower portion of the tubular member thereof in the same manner and for the same purpose as the various gas interchange conduits 158. The conduit 164 will be in communication with a pressure gauge 166 thereby enabling personnel or equipment at the surface facility to monitor the pressure conditions of the various tubular members. In the event the pressure gauge 166 shows a change in pressure, and indication is provided that one or more of the internal chambers 148 may be leaking. When this occurs, the tubular members will loose their buoyancy to compensate for small leakage the gas supply source 150 may be activated by an automatic gas pressure sensor 152 thus introducing additional air or other gas into the lower most tubular member. This gas is transferred sequentially up the buoyant tube chain until it is received by the leaking tubular member. If a gas supply exceeds the leakage rate of the leaking tubular member, the water within the tubular member will be displaced and the tubular member will be restored to its proper buoyancy.

The buoyancy of the respective tubular members is such that the weight thereof is effectively counterbalanced and the tubular members achieve an essentially neutral buoyancy in sea water. This is achieved by appropriate location of the lower most connection of the gas supply conduit and gas interchange conduits with the respective tubular members. Thus, the internal chambers 148 thereof are appropriately filled with gas such as air, neutral gas, etc. to render the buoyant tube chain substantially neutrally buoyant.

In the event one of the tubular members is leaking in the manner described above, it is desirable to identify which tubular member is leaking in order that it may be replaced when normal servicing activity is scheduled. Accordingly, each of the tubular members is provided with an electrical monitoring system in the manner shown in FIG. 14. As shown, an electrical conduit 168 is extended from the surface facility along the gas supply conduit 151. At the level of each tubular member 133, an electrical branch conduit extends from the electrical control cable and through the water interchange opening 149. Normally open contacts 170 are provided in the electrical circuit, which, when contacted by water, identify a significant change in resistivity. When this occurs, an electrical read out at the surface based facility clearly indicates which of the tubular members is leaking. Its leakage rate can also be monitored by determining the length of time which passes when the water level within the chamber 148 rises from the level shown in FIG. 14 to the level of the resistivity contacts 170. The electrical inspection system may also be provided with an alternative water level detector 172 which provides a redundant capability for detection of water level within the internal chambers 148 of the various tubular members 133.

It is therefore seen that an effective pressure balanced buoyant tube chain is provided enabling the development of a simple and efficient anti-catenary mooring system. Such mooring systems can be efficiently monitored to insure serviceability thereof over extended periods of time.

In many cases, it is desirable that there be provided a buoyant tube chain capability for provision of an anti-catenary mooring system, but it is also desirable that the mooring system incorporate a conventional unbroken anchor cable such as may be defined by an unbroken link of large diameter wire rope. According to the features disclosed in FIGS. 15–20, an alternative embodiment of the anti-catenary mooring system is disclosed. As shown in FIG. 15, an alternative anti-catenary mooring system is shown generally at 180 which includes an unbroken length of wire rope 182, the upper extremity of which is connected to the vessel or structure being moored while the lower extremity is securely fastened to an appropriate anchor at the ocean floor. Ordinarily, such anchor cables will define a catenary and the ability for efficient stationing under a wide variety of wind, wave and current conditions is somewhat impaired. According to the teachings hereof, a plurality of buoyancy chambers are employed which are appropriately secured to the wire rope or cable 182. Each of these buoyancy chambers is shown generally at 184 and is described in greater detail in the succeeding FIGS. 16–20. As is evident from the figures, the elongated buoyancy member 184 is of hollow configuration defining an internal chamber 185 which is partially filled with air or other suitable gas in the manner discussed above in connection with FIGS. 12–14. The buoyancy member 184 is of generally cylindrical configuration if desired forming an elongated partially cylindrical wall structure 186 to which is connected end walls 188 and 190. The tubular member 186 and the end walls 190 may if desired be composed of a resilient material such as natural or synthetic rubber which may be reinforced by a fabric material of nonmetal or metal character as desired.

As shown in the end views of FIGS. 18, 19, and 20, the elongated buoyancy members 184 are of generally U-shaped cross-sectional configuration defining an elongated channel 192 of sufficient dimension to receive the wire rope anchor line 182. The channel 192 is defined by outwardly converging surfaces 194 and 196 which cooperatively define a restricted channel inlet opening 198 as shown in FIG. 18. The channel inlet opening 198 is further defined by opposed dove-tail connector members 200 and 202 which are positioned in the normal or relaxed state of the structure in the manner shown in FIG. 18. The channel 192 is of slightly smaller dimension than the dimension of the wire rope 182. Therefore, upon insertion of the wire rope into the channel 192 the opposed surfaces 194 and 196 are forced apart as shown in FIG. 19 thereby forcing the dove tail connector elements 200 and 202 to a more widely spaced relation. A gas supply line 204 and a gas transfer conduit 206 together with an electrical monitoring cable 208 may also be located within the channel 192 along with the wire rope 182 as shown in FIG. 20. The dove tail connector elements 200 and 202 are then forced toward one another in any suitable manner and an elongated key member 210 with a dove tail slot 212 formed therein is assembled about the dove tail connector members 200 and 202. When the dove tail connectors are forced together to the position shown in FIG. 20, the respective lateral surfaces 194 and 196 are forced into tightly retaining engagement with the wire rope 182. Thus, the elongated buoyancy member 184 becomes seized or positively located with respect to the anchor cable 182.

As shown in FIG. 17, the wall structure 186 of the buoyancy member 184 is formed to define a water interchange opening 214 through which the air supply or air interchange conduits respectively extend so as to locate a gas supply opening 216 at the upper most portion of the buoyancy chamber. When the chamber is positioned along the mooring line in the manner shown in FIGS. 12–14, the water level within the chamber 185 may be forced downwardly to the level of the gas outlet opening 218 of the next succeeding gas transfer conduit. In the event any of the buoyancy members of the anti-catenary tube change should begin to leak, such leakage may be detected by resistivity contact members 220 of the various electrical circuits 208. Again, leakage of small volume may be compensated for simply by introducing additional air or other gas into the internal chamber of the lower most buoyancy member for displacement of water from the leaking buoyancy member in the manner discussed above. If leakage is sufficient that the buoyancy member must be replaced, this may be accomplished simply by replacing the retainer key member 210 and spreading the dove tail connector 200 and 202 sufficiently to release the buoyancy member from the cable 182. The buoyancy member then may be simply removed and replaced. Since the buoyancy member is composed of a resilient material such as natural or synthetic rubber, it may be sufficiently repaired and reinstalled for subsequent use.

In view of the foregoing, it is readily seen that this invention is one the well adapted to obtain all of the features and objects hereinabove set forth together with other features and objects which will become apparent from an understanding of the apparatus itself. It is to be understood that this invention is illustrated only by way of particular embodiments and is not intended to be limiting of the spirit and scope thereof but rather by the scope of the claims which follow.

What is claimed is:

1. A substantially neutrally buoyant marine petroleum storage and handing facility comprising:

(a) an elongated submersible storage vessel having side wall means, bottom wall means and top wall means and defining at least one internal chamber located within said side wall means and between said top and bottom wall means, said elongated submersible storage vessel being positionable with said top wall means at a preselected depth relative to means sea level;

(b) sea water inlet means located at one of said side wall means and bottom wall means and being normally open permitting unrestricted ingress and egress of sea water into the lower portion of said elongated submergible storage vessel;

(c) oil/water interface means being movably positioned within said internal chamber and partitioning said internal chamber into a variable volume sea water chamber at the lower portion of said internal chamber and a variable volume oil and gas chamber above said oil/water interface means;

(d) means conducting well production flow, including oil, gas, basic sediment and water, into said oil and gas chamber;

(e) water discharge conduit means communicating with the lower portion of said oil and gas chamber and conducting basic sediment and water from said oil and gas chamber;

(f) gas discharge means communicating with the upper portion of said oil and gas chamber and permitting selective removal of gas therefrom;

(g) oil discharge means adapted for communication with the upper portion of a column of oil within said oil and gas chamber; and (h) means locating said elongated submersible storage vessel at an intended marine site.

2. A substantially neutral buoyancy marine petroleum storage and handling facility as recited in claim 1, wherein:

said oil/water interface means has a specific gravity between the specific gravity of sea water and the specific gravity of oil.

3. A substantially neutral buoyancy marine petroleum storage and handling facility as recited in claim 2, wherein:

(a) said oil/water interface means is in the form of a piston having close fitting relation with the internal wall surface of said side wall means, said piston defining a water and sludge separator and collection basin;

(b) said water discharge conduit means communicating with said water and sludge separator and collection basin; and (c) means discharging said water and sludge from said water and sludge separator and collection basin through said water discharge conduit means to a suitable site for disposal.

4. A substantially neutral buoyancy marine petroleum storage and handling facility as recited in claim 3, said piston defining a funnel shaped upper wall surface forming said basin and having an outlet opening at the apex thereof, said outlet opening being in communication with said water discharge conduit means.

5. A substantially neutral buoyancy marine petroleum storage and handling facility as recited in claim 3, wherein said means conducting well production flow into said oil and gas chamber and said water discharge conduit means are each defined by extendable and contractible conduit means communicating through said oil/water interface means with said oil and gas chamber.

6. A substantially neutral buoyancy marine petroleum storage and handling facility as recited in claim 3, wherein said oil/water interface defines oil collector means for collecting any oil that might separate from said inner surface means of said sidewall means within said variable volume sea water chamber and rise to the upper extremity of said variable volume sea water chamber.

7. A substantially neutral buoyancy marine petroleum storage and handling facility as recited in claim 1, wherein said gas removal means comprises:

(a) gas outlet conduit means in communication with the upper portion said oil and gas chamber; and (b) means controlling the discharge of gas from said oil and gas chamber through said gas outlet conduit means.

8. A substantially neutral buoyancy marine petroleum storage and handling facility as recited in claim 1, wherein said oil discharge means comprises:

(a) an oil discharge float capable of floating at the surface of oil within said oil and gas chamber;

(b) an extendable and retractable conduit having the lower end thereof supported and positioned by said oil discharge float; and (c) an oil discharge conduit being in communication with the upper portion of said oil and gas chamber and being in fluid communication with the upper end of said extendable and retractable conduit.

9. A substantially neutral buoyancy marine petroleum storage and handling facility as recited in claim 1, wherein:

(a) said upper wall means of said elongated submergible storage vessel defines a support platform for a service vessel to be removably located thereon with a major portion thereof positional above the surface of the ocean; and (b) the buoyancy of said elongated submersible storage vessel is controllable to compensate for the weight of said service vessel and the volume of oil, water and gas.

10. A substantially neutral buoyancy marine petroleum storage and handling facility as recited in claim 9, wherein:

said lower wall means of said elongated submersible is positionable in spaced relation with the ocean floor.

11. A substantially neutral buoyancy marine petroleum storage and handling facility as recited in claim 1, wherein:

(a) an upper portion of said elongated submersible storage vessel is intended to project above the surface of the ocean and defines docking means for a service vessel; and (b) the buoyancy of said elongated submersible storage vessel is controllable to compensate for the weight of said service vessel.

12. A substantially neutral buoyancy marine petroleum storage and handling facility as recited in claim 1, wherein said means for locating said elongated submersible vessel at an intended marine site comprises:

(a) a plurality of anti-catenary connectors having the upper ends thereof connected to selected portions of said elongated submersible and extending in substantially straight line manner to laterally displace locations at the ocean floor; and (b) anchor means securing the lower ends of said anti-catenary connectors to the ocean floor.

13. A substantially neutral buoyancy marine petroleum storage and handling facility as recited in claim 12 wherein said anti-catenary connectors each comprise:

(a) a plurality of elongated tube members each defining an internal chamber and forming water opening means at the lower portion for communicating said internal chamber with the water in which aid elongated tube members are submerged;

(b) a source of pressurized gas;

(c) gas supply means being in communication with the upper extremity of said internal chamber; and (d) gas transfer means being in communication with said internal chamber at a predetermined level above said water opening means and being capable of conducting as from said internal chamber when the water level therein is below said predetermined level.

14. A substantially neutral buoyancy marine petroleum storage and handling facility as recited in claim 13, wherein said gas transfer means comprises:

gas transfer conduit means having the lower end thereof in communication with said internal chamber at said predetermined level, said gas transfer conduit means having the upper end thereof in communication with the internal chamber of the next higher elongated tube member at a location near the upper extremity thereof.

15. A substantially neutral buoyancy marine petroleum storage and handling facility as recited in claim 14, including pressure inspection means in communication with said gas transfer conduit means of the upper most one of said elongated tube members, permitting inspection of pressure changes in the internal chambers of all of said elongated tube members.

16. A substantially neutral buoyancy marine petroleum storage and handling facility as recited in claim 13, wherein:

said elongated tube members are individually replaceable in the event of leakage thereof.

17. A substantially neutral buoyancy marine petroleum storage and handling facility as recited in claim 13, wherein:

(a) electrical leakage indicator circuit means extends from said internal chamber of each of said elongated tubular members to electrical indicator means located for inspection by workers; and (b) resistance means being provided in said electrical leakage indicator circuit means and being located above the normal water level within said internal chamber, upon leakage of one of said elongated tubular members the water level will rise therein and contact said resistance means, whereby said electrical indicator means will reflect a change in the resistivity, indicating a particular elongated tubular member to be leaking.

18. A substantially neutral buoyancy marine petroleum storage and handling facility as recited in claim 13, wherein:

(a) each of said elongated tubular members is of generally rigid construction; and (b) connection means interconnects said elongated tubular members inarticulated end-to-end relation.

19. A substantially neutral buoyancy marine petroleum storage and handling facility as recited in claim 13, wherein:

(a) each of said elongated tubular members defines internal wall structure forming a cable channel extending from end-to-end thereof;

(b) an anchor line for interconnecting said petroleum storage and handling facility is receivable within said cable channel; and (c) retainer means is removably interlocked with said elongated tubular members to retain said elongated tubular members in assembly with said anchor line.

20. A substantially neutral buoyancy marine petroleum storage and handling facility as recited in claim 19, wherein:

(a) said elongated tubular members are of generally U-shaped cross-sectional configuration sand define opposed connector means at each side of said cable channel; and (b) said retainer means is an elongated key member releasably engaging said opposed connector means and forcing said internal wall structure into tightly gripping relation with said anchor line.

* * * * *